US011293661B2

(12) United States Patent
Xiong et al.

(10) Patent No.: US 11,293,661 B2
(45) Date of Patent: Apr. 5, 2022

(54) MULTI-UNIT AIR CONDITIONING SYSTEM AND A CONTROLLING METHOD OF MULTI-UNIT AIR CONDITIONING SYSTEM

(71) Applicants: GD MIDEA HEATING & VENTILATING EQUIPMENT CO., LTD., Foshan (CN); MIDEA GROUP CO., LTD., Foshan (CN)

(72) Inventors: Meibing Xiong, Foshan (CN); Yongfeng Xu, Foshan (CN); Zekun Liang, Foshan (CN); Linxing Ren, Foshan (CN); Wen Huang, Foshan (CN)

( * ) Notice: Subject to any disclaimer, the term of this patent is extended or adjusted under 35 U.S.C. 154(b) by 0 days.

(21) Appl. No.: 14/754,579

(22) Filed: Jun. 29, 2015

(65) Prior Publication Data

US 2016/0363335 A1 Dec. 15, 2016

(30) Foreign Application Priority Data

Jun. 9, 2015 (CN) ..... 201510313911.4

(51) Int. Cl.
*F24F 11/62* (2018.01)
*F24F 11/30* (2018.01)
(Continued)

(52) U.S. Cl.
CPC ..... *F24F 11/62* (2018.01); *F24F 11/30* (2018.01); *F24F 11/52* (2018.01); *F24F 11/54* (2018.01); *F24F 11/65* (2018.01)

(58) Field of Classification Search
CPC .. F24F 11/30; F24F 11/52; F24F 11/54; F24F 11/62; F24F 11/65; F24F 11/89;
(Continued)

(56) References Cited

U.S. PATENT DOCUMENTS 5,142,877 A * 9/1992 Shimizu ..... F24F 3/065 62/129
5,207,070 A * 5/1993 Miyazaki ..... F24F 11/085 165/208
(Continued)

FOREIGN PATENT DOCUMENTS

CN 1490570 A 4/2004
CN 103123194 A 5/2013
(Continued)

OTHER PUBLICATIONS

Translated JP2016118350.pdf.*
Chinese Patent Application No. 201510313911.4, First Office Action dated May 3, 2017, with English translation, 21 pages.

*Primary Examiner* — Larry L Furdge
*Assistant Examiner* — Chang H Park
(74) *Attorney, Agent, or Firm* — Kilpatrick Townsend & Stockton, LLP

(57) ABSTRACT

A multi-unit air conditioning system includes an outdoor unit, a first indoor unit, a second indoor unit, a third indoor unit, and a mode conversion device. The outdoor unit includes an outdoor-unit controller and a selector. The first indoor unit includes a first indoor-unit controller. The second indoor unit includes a second indoor-unit controller. The selector is configured to send a first selection signal or a second selection signal. The outdoor-unit controller is configured to control the outdoor unit, the first indoor-unit controller and the second indoor-unit controller to operate under a first control mode according to the first selection signal. The outdoor-unit controller is configured to control the outdoor unit, the first indoor-unit controller and the second indoor-unit controller to operate under a second control mode according to the second selection signal.

5 Claims, 6 Drawing Sheets

(51) Int. Cl.
*F24F 11/54* (2018.01)
*F24F 11/65* (2018.01)
*F24F 11/52* (2018.01)

(58) Field of Classification Search
CPC ..... F25B 2313/006; F25B 2313/023; F25B 2313/0231; F25B 2313/0233; F25B 2313/029; F25B 2313/0292; F25B 2313/0293; F25B 2600/11; F25B 2600/111; F25B 2600/112
USPC ..... 62/159
See application file for complete search history.

(56) References Cited

U.S. PATENT DOCUMENTS 6,102,114 A * 8/2000 Nishihara ..... F24F 3/065 165/207
7,676,300 B2 * 3/2010 Kim ..... H04L 12/282 700/276
7,797,953 B2 * 9/2010 Yokoi ..... F24F 11/006 62/159
2009/0030555 A1 * 1/2009 Gray ..... F24F 11/30 700/277
2009/0056352 A1 * 3/2009 Kim ..... F24F 3/065 62/175
2010/0082162 A1 * 4/2010 Mundy ..... F24F 3/044 700/277
2012/0285655 A1 * 11/2012 Lee ..... F24F 3/065 165/11.1

FOREIGN PATENT DOCUMENTS

CN 104033995 A 9/2014
CN 104296281 A 1/2015
EP 2056032 B1 * 2/2012 ..... F24F 3/065
EP 2056032 B1 * 2/2012 ..... F24F 3/065
EP 3239622 B1 * 6/2019 ..... F24F 11/89
JP H11325559 A 11/1999
JP 2016118350 A * 6/2016 ..... F24F 11/65

* cited by examiner

MULTI-UNIT AIR CONDITIONING SYSTEM AND A CONTROLLING METHOD OF MULTI-UNIT AIR CONDITIONING SYSTEM

CROSS-REFERENCE TO RELATED APPLICATION

This application claims priority to and benefits of Chinese Patent Application Serial No. 201510313911.4, filed with the State Intellectual Property Office of P. R. China on Jun. 9, 2015, the entire contents of which are incorporated herein by reference.

FIELD

The present disclosure relates to air conditioning technology field, and more particularly, to a multi-unit air conditioning system and a controlling method of the multi-unit air conditioning system.

BACKGROUND

Currently, with the improved people's life, a multi-unit air conditioning system, such as a central air conditioner, is more and more popular with people. The multi-unit air conditioning system is installed to various indoor places, such as offices, conference rooms and homes, and other places.

Generally, the multi-unit air conditioning system includes an outdoor unit, a number of indoor units and a mode conversion device. The outdoor is connected to the indoor units through the mode conversion device.

A single group of pipes of the multi-unit air conditioning system allows the multi-unit air conditioning system to operate under a same operating mode. Therefore, when the multi-unit air conditioning system is operating, mode conflict problem of the indoor units needs to be taken into account. For example, when the mode conversion device operates under the heating mode, the gas pipe is hot. Therefore, other indoor units connected with a same group of pipes cannot operate under the cooling mode. The other indoor units show mode conflict errors and cannot be turned on.

There are some ways to solve the mode conflict problems of the indoor units. For example, when there is a mode conflict problem, the multi-unit air conditioning system can choose an operating mode as a priority operating mode according to customers' demand. The indoor unit which is under mode conflict reports failure and is turned off.

Although the above way can avoid influence caused by mode conflict to the customer and avoid complaint from the customer, the above way is defense-oriented and does not look into the main contradiction of mode conflict, and cannot avoid the influence to the customers maximally.

SUMMARY

The present disclosure aims to solve one of the technical problems at least to some extent. Therefore, it is an objective of the present disclosure to provide a multi-unit air conditioning system and a controlling method of the multi-unit air conditioning system.

A multi-unit air conditioning system includes an outdoor unit, a first indoor unit and a second indoor unit. The outdoor unit includes an outdoor-unit controller and a selector. The first indoor unit includes a first indoor-unit controller. The second indoor unit includes a second indoor-unit controller.

The selector is configured to send a first selection signal or a second selection signal. The outdoor-unit controller is configured to control the outdoor unit, the first indoor-unit controller and the second indoor-unit controller to operate under a first control mode according to the first selection signal. The outdoor-unit controller is configured to control the outdoor unit, the first indoor-unit controller and the second indoor-unit controller to operate under a second control mode according to the second selection signal. The first indoor-unit controller is configured to receive a mode-on signal. The mode-on signal is used to turn on a first operating mode of the first indoor unit. The outdoor-unit controller is configured to determine whether a second operating mode under which the second indoor unit operates is the same as the first operating mode. Under the second control mode, if no, the first indoor-unit controller is configured to turn on an indoor-unit fan of the first indoor unit and send a mode conversion signal to the outdoor-unit controller. The outdoor-unit controller is configured to convert an operating mode of the outdoor unit according to the mode conversion signal. When mode conversion of the outdoor unit is complete, the first indoor-unit controller is configured to control the first indoor unit to operate under the first operating mode, and send parameters of the first operating mode to the second indoor-unit controller. The second indoor-unit controller is configured to control operation of the second indoor unit according to the parameters of the first operating mode. If yes, the first indoor-unit controller is configured to control the first indoor unit to operate under the first operating mode.

In the multi-unit air conditioning system, the first control mode can be a customized mode that solves mode-conflict problems. Under the second control mode, when the first operating mode under which the first indoor unit needs to operate is different from the second operating mode under which the second indoor unit operates, the second indoor-unit controller can control the second indoor unit to operate according to the parameters of the first operating mode, avoiding turning off the second indoor unit. This can reduce influence caused by turning off the second indoor unit to the user maximally. Meanwhile, before the mode conversion of the outdoor unit is complete, the first indoor unit turns on the indoor-unit fan first, thereby starting the first operating mode faster and saving conversion time. This improves the user's experience.

In one embodiment of the present disclosure, when the mode conversion of the outdoor unit is complete, the outdoor-unit controller is configured to send a first complete signal to the first indoor-unit controller. The first indoor-unit controller is configured to determine that the mode conversion of the outdoor unit is complete according to the first complete signal.

In one embodiment of the present disclosure, the outdoor unit includes an outdoor-unit liquid pipe and a first gas pipe. The first indoor unit includes a first indoor-unit liquid pipe and a first indoor-unit gas pipe. The second indoor unit includes a second indoor-unit liquid pipe and a second indoor-unit gas pipe. The outdoor-unit liquid pipe is connected to the first indoor-unit liquid pipe and the second indoor-unit liquid pipe. The first gas pipe is connected to the first indoor-unit gas pipe and the second indoor-unit gas pipe.

In one embodiment of the present disclosure, the multi-unit air conditioning system further includes a mode conversion device. The mode conversion device includes a conversion controller. The outdoor-unit controller is configured to control the conversion controller to operate under the first control mode according to the first selection signal. The outdoor-unit controller is configured to control the conversion controller to operate under the second control mode according to the second selection signal. If the second operating mode is different from the first operating mode, the first indoor-unit controller is configured to send the mode conversion signal to the conversion controller. The conversion controller is configured to convert the operating mode of the mode conversion device according to the mode conversion signal. When the mode conversion of the mode conversion device is complete, the first indoor-unit controller is configured to control the first indoor unit to operate under the first operating mode, and send parameters of the first operating mode to the second indoor-unit controller.

In one embodiment of the present disclosure, when the mode conversion of the outdoor unit is complete, the outdoor-unit controller is configured to send a first complete signal to the first indoor-unit controller. When the mode conversion of the mode conversion device is complete, the conversion controller is configured to send a second complete signal to the first indoor-unit controller. The first indoor-unit controller is configured to determine that the mode conversion of the outdoor unit and the mode conversion device is complete according to the first complete signal and the second complete signal.

In one embodiment of the present disclosure, the outdoor unit includes an outdoor-unit liquid pipe, a first gas pipe and a second gas pipe. The mode conversion device includes an outdoor-unit liquid pipe port, a first gas pipe port, a second gas pipe port, a first indoor-unit liquid pipe port, a second indoor-unit liquid pipe port, a first indoor-unit gas pipe port and a second indoor-unit gas pipe port. The first indoor unit includes a first indoor-unit liquid pipe and a first indoor-unit gas pipe, the second indoor unit includes a second indoor-unit liquid pipe and a second indoor-unit gas pipe. The outdoor-unit liquid pipe is connected to the outdoor-unit liquid pipe port. The first gas pipe is connected to the first gas pipe port. The second gas pipe is connected to the second gas pipe port. The first indoor-unit liquid pipe port is connected to the first indoor-unit liquid pipe. The second indoor-unit liquid pipe port is connected to the second indoor-unit liquid pipe. The first indoor-unit gas pipe port is connected to the first indoor-unit gas pipe. The second indoor-unit gas pipe port is connected to the second indoor-unit gas pipe.

In one embodiment of the present disclosure, the first indoor unit includes an indicator. If the second operating mode is different from the first operating mode, the first indoor-unit controller is configured to turn on the indicator.

In one embodiment of the present disclosure, parameters of the first operating mode include a set temperature and a fan speed.

A controlling method of the multi-unit air conditioning system includes following steps of:

S1: the selector sending a first selection signal, and entering step S2, or the selector sending a second selection signal and entering step S3;

S2: the outdoor-unit controller controlling the outdoor unit, the first indoor unit and the second indoor unit to operate under a first control mode according to the first selection signal;

S3: the outdoor-unit controller controlling the outdoor unit, the first indoor unit and the second indoor unit to operate under a second control mode according to the second selection signal, and entering step S4;

S4: the first indoor-unit receiving a mode-on signal, the mode-on signal being used to turn on a first operating mode of the first indoor unit, and entering step S5;

S5: the outdoor-unit controller determining whether a second operating mode under which the second indoor unit operates is the same as the first operating mode, if no, entering step S6, if yes, entering step S7;

S6: the first indoor-unit controller turning on an indoor-unit fan of the first indoor unit and sending a mode conversion signal to the outdoor-unit controller, and entering step S8;

S7: the first indoor-unit controller controlling the first indoor unit to operate under the first operating mode;

S8: the outdoor-unit controller converting an operating mode of the outdoor unit according to the mode conversion signal and entering step S9;

S9: when mode conversion of the outdoor unit is complete, the first indoor-unit controller controlling the first indoor unit to operate under the first operating mode, and sending parameters of the first operating mode to the second indoor-unit controller, and entering step S10;

S10: the second indoor-unit controller controlling operation of the second indoor unit according to the parameters of the first operating mode.

In one embodiment of the present disclosure, the step S9 includes following steps of:

S91: when the mode conversion of the outdoor unit is complete, the outdoor-unit controller sending a first complete signal to the first indoor-unit controller, and entering step S92;

S92: the first indoor-unit controller determining that the mode conversion of the outdoor unit is complete according to the first complete signal and entering step S93;

S93: the first indoor-unit controller controlling the first indoor unit to operate under the first operating mode and sending the parameters of first operating mode to the second indoor-unit controller, and entering step S10.

In one embodiment of the present disclosure, the multi-unit air conditioning system further includes a mode conversion device, and the mode conversion device includes a conversion controller. The step S2 includes: the outdoor-unit controller controlling the conversion controller to operate under the first control mode according to the first selection signal. The step S3 includes: the outdoor-unit controller controlling the conversion controller to operate under the second control mode according to the second selection signal. The step S6 includes: the first indoor-unit controller sending the mode conversion signal to the conversion controller. The step S8 includes: the conversion controller converting an operating mode of the mode conversion device according to the mode conversion signal. The step S9 includes: when the mode conversion of the mode conversion device is complete, the first indoor-unit controller controlling the first indoor unit to operate under the first operating mode, and sending the parameters of the first operating mode to the second indoor-unit controller.

In one embodiment of the present disclosure, the step S9 includes following steps of:

S91: when the mode conversion of the outdoor unit is complete, the outdoor-unit controller sending a first complete signal to the first indoor-unit controller, when the mode conversion of the mode conversion device is complete, the conversion controller sending a second complete signal to the first indoor-unit controller, and entering step S92;

S92: the first indoor-unit controller determining that the mode conversion of the outdoor unit and the mode conversion device is complete according to the first complete signal and the second complete signal, and entering step S93.

S93: the first indoor-unit controller controlling the first indoor unit to operate under the first operating mode, and sending the parameters of the first operating mode to the second indoor-unit controller, and entering the step S10.

In one embodiment of the present disclosure, the first indoor unit includes an indicator. The step S6 includes: the first indoor-unit controller turning on the indicator.

Additional aspects and advantages of the embodiments of the present disclosure will be given in part in the following descriptions, and become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which.

DETAILED DESCRIPTION

Figure 1:
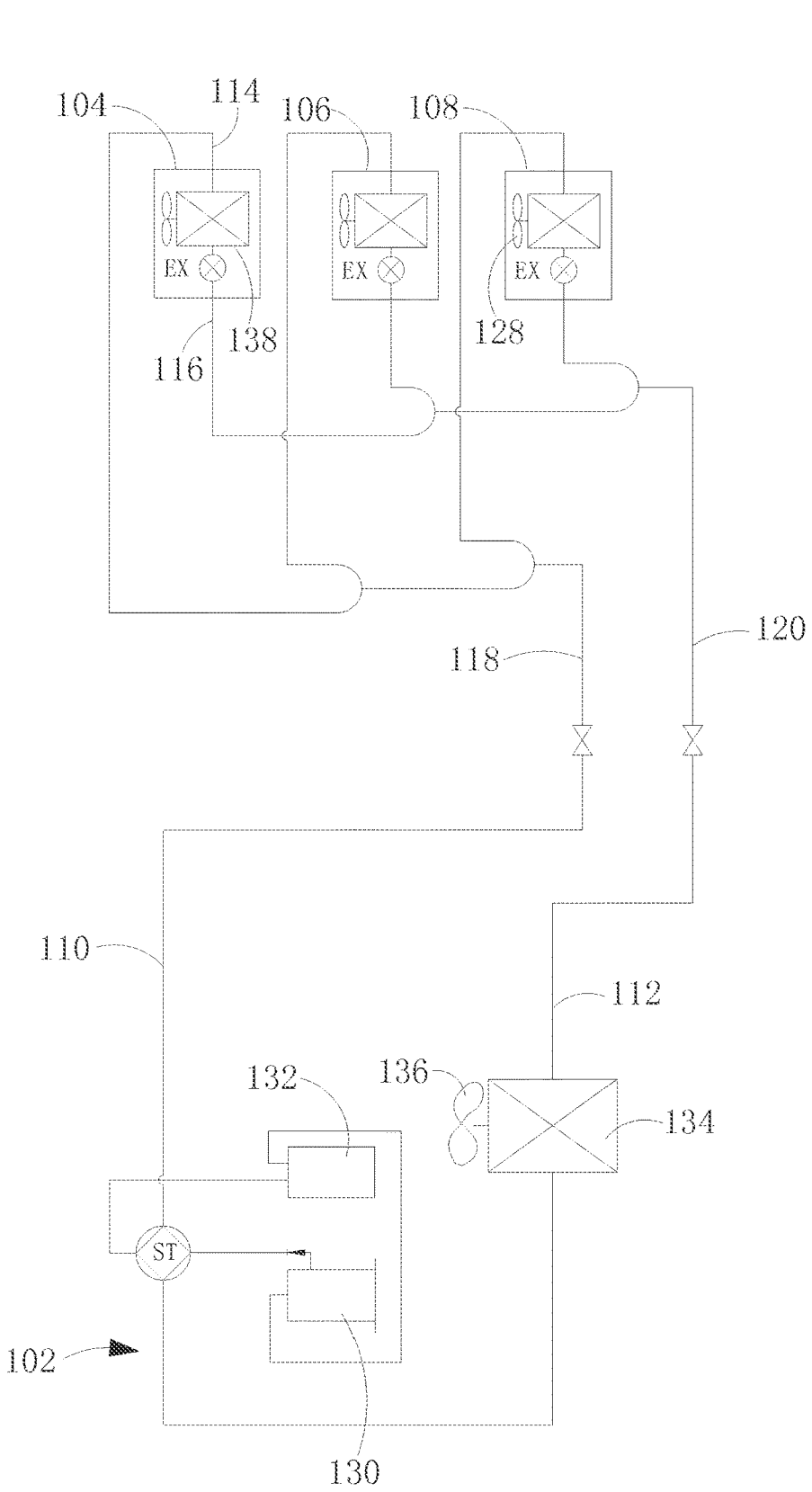
FIG. 1 is a schematic view of a multi-unit air conditioning system, according to one embodiment of the present disclosure.

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be construed to limit the present disclosure.

In descriptions of the present disclosure, it is understood that, the direction or position relationships, which are defined by terms such as "center", "longitudinal", "lateral", "length", "width", "thickness", "up", "down", "front", "rear", "left", "right", "vertical", "horizontal", "top", "bottom", "inside", "outside", "clockwise", "counterclockwise", "axial", "radial", "circumferential", etc., are based on direction or position relationships shown in the figures. They are only used for convenience of describing the present disclosure and simplifying the descriptions and are not intended to indicate or imply specific directions, specific structures and operations which the device or the element must have. Therefore, they cannot be understood as a limitation to the present disclosure. In addition, terms such as "first" and "second" are used herein for purposes of description and are not intended to indicate or imply relative importance or significance or imply a number of technical features indicated. Therefore, a "first" or "second" feature may explicitly or implicitly include one or more features. Further, in the description, unless indicated otherwise, "a number of" refers to two or more.

In the present disclosure, unless indicated otherwise, terms such as "install", "connect", "fix", etc., should be understood broadly. For example, it can be a fixed connection, it also can be a detachable connection or an integration. It can be a mechanical connection, or can be an electrical connection. It can be a direct connection and also can be an indirect connection through an intermediate media. It can be a connection inside two elements or mutual relationships of two elements, unless indicated otherwise. For those skilled in the art, specific meaning of the above terms in the present disclosure can be understood according to specific situations.

In the present disclosure, unless indicated otherwise, a first feature "on" or "under" a second feature may include an embodiment in which the first feature directly contacts the second feature, and may also include an embodiment in which an additional feature is formed between the first feature and the second feature so that the first feature does not directly contact the second feature.

Referring to FIG. 1, a multi-unit (Variable Refrigerant Volume) air conditioning system, according to a first embodiment of the present disclosure, includes an outdoor unit and a number of indoor units. The outdoor unit 102 is connected to the indoor units.

Specifically, in this embodiment, number of the indoor units is three. For convenient descriptions, the three indoor units are designated as a 1# indoor unit 104, a 2# indoor unit 106 and a 3# indoor unit 108 from left to right in the FIG. 1.

The outdoor unit 102 includes an outdoor-unit liquid pipe 110 and a first gas pipe 112. The outdoor-unit liquid pipe 110 may be used to transfer liquid refrigerant, for example. The first gas pipe 112 may be used to transfer gaseous refrigerant, for example.

Each indoor unit includes an indoor-unit liquid pipe 114 and an indoor-unit gas pipe 116. The outdoor-unit liquid pipe 110 is connected to the indoor-unit liquid pipes 114 of the three indoor units via a first connection pipe 118. The first gas pipe 112 is connected to the indoor-unit gas pipes 116 of the three indoor units via a second connection pipe 120.

Figure 2:
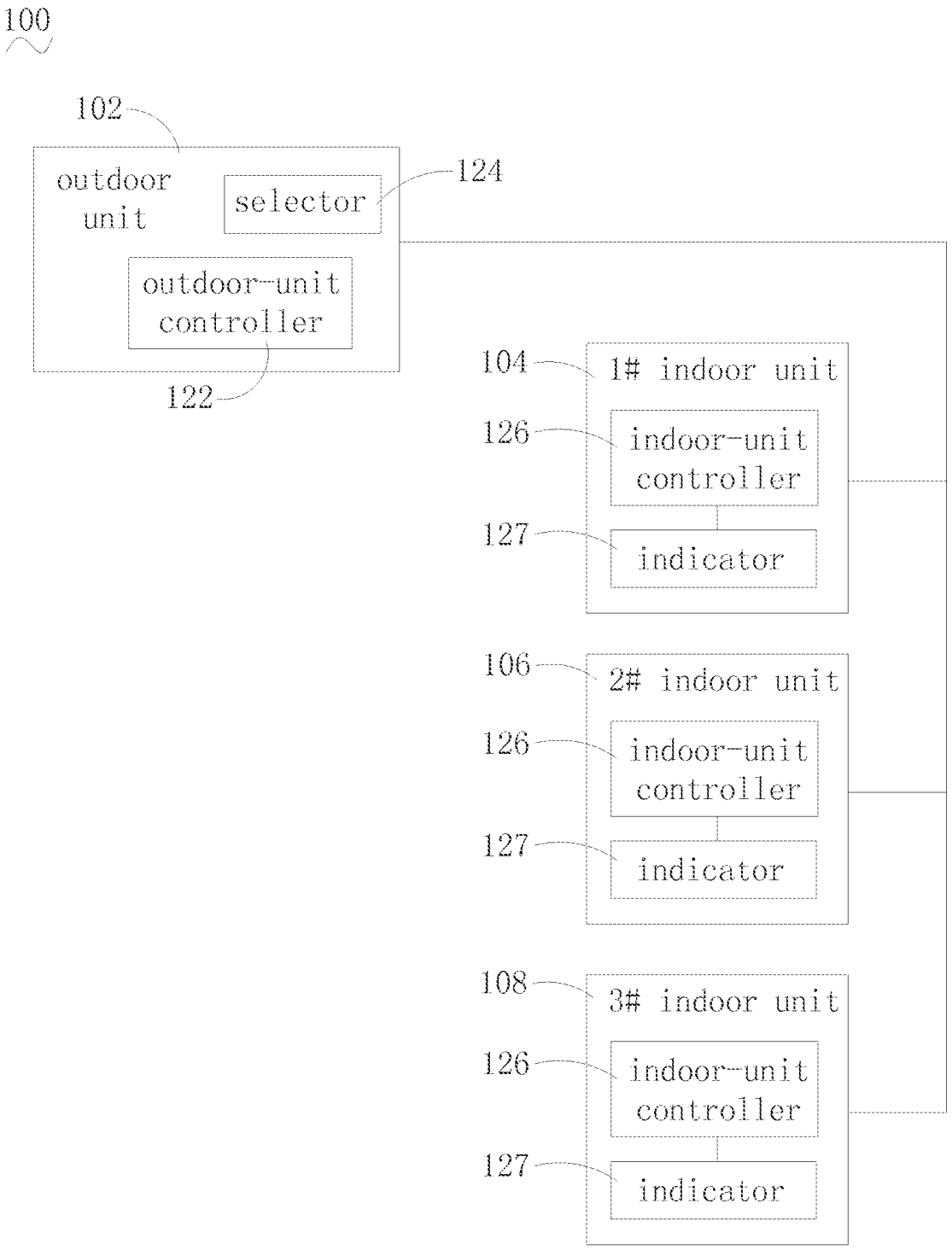
FIG. 2 is a block diagram of a multi-unit air conditioning system, according to one embodiment of the present disclosure.

Referring to FIG. 2, the outdoor unit 102 includes an outdoor-unit controller 122 and a selector 124. Each indoor unit includes an indoor-unit controller 126.

The outdoor-unit controller 122 and the selector 124 can be set on a control board of the outdoor unit 102. The indoor-unit controller 126 can be set on a control board of the indoor unit. The outdoor-unit controller 122 and the indoor-unit controller 126 can transmit data to each other by a wired way.

The selector 124 is configured to send a first selection signal or a second selection signal. In this embodiment, the selector 124 includes a DIP switch, but other selector types could be used without departing from the scope hereof. The user can control the DIP switch to make the selector 124 to send the first selection signal or the second selection signal. For example, when the DIP switch is turned to one side, the selector 124 sends the first selection signal to the outdoor-unit controller 122, the multi-unit air conditioning system 100 is under a first control mode. The outdoor-unit controller 122 controls the indoor-unit controllers 126 of the three indoor units to operate under the first control mode according to the first selection signal. It can be understood that, the outdoor-unit controller 122 is under an asynchronous control mode.

When the DIP switch is turned to another side, the selector 124 sends the second selection signal to the outdoor-unit controller 122. The multi-unit air conditioning system 100 is under a second control mode. The outdoor-unit controller 122 controls the indoor-unit controllers 126 of the three indoor units to operate under the second control mode according to the second selection signal. It can be understood that, the outdoor-unit controller 122 is under a synchronous control mode. The first control mode is different from the second control mode.

It can be understood that, the selector 124 can include different devices to allow the user to choose the first control mode or the second control mode.

The outdoor-unit controller 122 is configured to control operation of the multi-unit air conditioning system 100 according to user instructions sent by the indoor unit. For example, when the multi-unit air conditioning system 100 is under standby state, all indoor units are closed. When the user presses an "on/off" button on the remote control of the indoor unit to turn on one of the indoor units, for example, the 1# indoor unit 104, particularly the indoor-unit controller 126 of the 1# indoor unit 104 receives the turn-on instruction and sends the turn-on instruction to the outdoor-unit controller 122. The outdoor-unit controller 122 controls the outdoor unit 102 and the 1# indoor unit 104 to operate under a default operating mode or an operating mode under which the 1# indoor unit 104 operates before last-time turning-off of the 1# indoor unit 104.

The indoor-unit controller 126 is configured to receive and send the user instruction to the outdoor-unit controller 122, and control the indoor unit according to a control signal fed back by the outdoor-unit controller 122. As stated above, the indoor-unit controller 126 of the 1# indoor unit 104 sends the turn-on instruction to the outdoor-unit controller 122. The indoor-unit controller 126 of the 1# indoor unit 104 receives the control signal fed back by the outdoor-unit controller 122, and controls the 1# indoor unit 104 to operate under the default operating mode or other operating modes according to the control signal. The control signal fed back by the outdoor-unit controller 122 indicates that the outdoor unit 102 is ready for the 1# indoor unit 104 to operate under the default operating mode or other operating modes.

Under the first control mode (the outdoor-unit controller 122 is under the asynchronous control mode), the multi-unit air conditioning system 100 can process mode conflict of the indoor units according to customized mode-conflict solutions. For example, the customized mode-conflict solutions include a cooling priority solution, a heating priority solution, a turned-on-most priority solution and a VIP priority solution, etc. These customized mode-conflict solutions can be preset in the non-volatile memory on the control board of the outdoor unit 102. Similarly, the control logic of the second control mode can also be stored in the non-volatile memory on the control board of the outdoor unit 102.

The cooling priority solution means that, when no indoor unit operates under the cooling mode, other operating modes of the indoor units can be turned on. When an indoor unit needs to operate under the cooling mode, the outdoor unit 102 operates under the cooling mode immediately. The outdoor-unit controller 122 turns off the indoor unit which operates under a different operating mode.

The heating priority solution means that, when no indoor unit operates under the heating mode, other operating modes of the indoor units can be turned on. When an indoor unit needs to operate under the heating mode, the outdoor unit 102 operates under the heating mode immediately. The outdoor-unit controller 122 turns off the indoor unit which operates under a different operating mode.

The turned-on-most priority solution means that, the outdoor-unit controller 122 uses the operating mode under which most of the indoor units operate as the priority operating mode. For example, in the three indoor units, the 1# indoor unit 104 and the 2# indoor unit 106 operate under the heating mode, and the 3# indoor unit 108 is closed. When the 3# indoor unit 108 needs to operate under the cooling mode, because the operating mode under which most of the indoor units operate is the heating mode, the outdoor-unit controller 122 uses the heating mode as the priority operating mode and controls the 3# indoor unit 108 to stay closed.

The VIP priority solution means that, the outdoor-unit controller 122 presets an indoor unit as a VIP indoor unit, such as the 3# indoor unit 108. When the 3# indoor unit 108 needs to operate under an operating mode, and the operating mode under which the 3# indoor unit 108 needs to operate is different from the operating modes under which other indoor units operate, the outdoor-unit controller 122 uses the operating mode under which the 3# indoor unit needs to operate as the priority operating mode and controls the 3# indoor unit 108 to operate under the operating mode and turns off other indoor units which operate under different operating modes.

The cooling priority solution is made as an example to solve the mode-conflict problem under the first control mode. Initially, the 1# indoor unit 104 and the 2# indoor unit 106 are closed, and the 3# indoor unit 108 operates under the heating mode.

When the user turns on the cooling mode of the 2# indoor unit 106 using the remote control of the indoor unit, the indoor-unit controller 126 of the 2# indoor unit 106 receives and sends the mode-on signal of the cooling mode to the outdoor-unit controller 122. The outdoor-unit controller 122 determines that the operating mode (the heating mode) under which the 3# indoor unit 108 operates currently is different from the operating mode (the cooling mode) under which the 2# indoor unit 106 is about to operate. The outdoor-unit controller 122 uses the operating mode under which the 2# indoor unit 106 is about to operate as the priority operating mode, and sends an off-signal to the 3# indoor unit 108 and controls the outdoor unit 102 to operate under the cooling mode. The indoor-unit controller 126 of the 3# indoor unit 108 turns off the 3# indoor unit according to the off-signal. Then, the outdoor-unit controller 122 sends a mode-conversion complete signal to the indoor-unit controller 126 of the 2# indoor unit 106. The indoor-unit controller 126 of the 2# indoor unit 106 controls the 2# indoor unit 106 to operate under the cooling mode according to the mode-conversion complete signal.

Under the second control mode (the outdoor-unit controller 122 is under the synchronous control mode), when one of the indoor-unit controllers 126 (hereafter a first indoor-unit controller) receives the mode-on signal from the remote control of the indoor unit, the first indoor-unit controller sends the mode-on signal to the outdoor-unit controller 122. The mode-on signal is used to turn on a first operating mode of one of the indoor units (hereafter a first indoor unit)

The outdoor-unit controller 122 is configured to determine whether a second operating mode under which another indoor unit (hereafter a second indoor unit) operates is the same as the first operating mode according to the mode-on signal.

If no, the first indoor-unit controller is configured to turn on an indoor-unit fan of the first indoor unit and send a mode conversion signal to the outdoor-unit controller 122. The outdoor-unit controller 122 is configured to convert the operating mode of the outdoor unit 102 according to the mode conversion signal.

When the mode conversion of the outdoor unit 102 is complete, the first indoor-unit controller is configured to control the first indoor unit to operate under the first operating mode, and send parameters of the first operating mode to the second indoor-unit controller. The second indoor-unit controller is configured to control operation of the second indoor unit according to the parameters of the first operating mode. Specifically, when the mode conversion of the outdoor unit 102 is complete, the outdoor-unit controller 122 is configured to send a first complete signal to the first indoor-unit controller. The first indoor-unit controller is configured to determine that the mode conversion of the outdoor unit is complete according to the first complete signal.

If yes, the first indoor-unit controller is configured to control the first indoor unit to operate under the first operating mode.

Preferably, each indoor unit includes an indicator 127. If the second operating mode is different from the first operating mode, the first indoor-unit controller is configured to turn on the indicator 127 of the first indoor unit. In this way, the user can know about the operation of each indoor unit.

An example is made to solve the mode-conflict problem under the second control mode.

The 3# indoor unit 108 is designated as the first indoor unit, and the 2# indoor unit 106 is designated as the second indoor unit. Initially, the 1# indoor unit 104 and the 3# indoor unit 108 are closed, and the 2# indoor unit 106 operates under the heating mode (the second operating mode).

When the user turns on the cooling mode (the first operating mode) of the 3# indoor unit 108 using the remote control of the 3# indoor unit 108, the indoor-unit controller 126 (the first indoor-unit controller) of the 3# indoor unit 108 receives and sends the mode-on signal to the outdoor-unit controller 122. The mode-on signal is used to turn on the cooling mode (the first operating mode).

The outdoor-unit controller 122 determines that the second operating mode (the heating mode) under which the 2# indoor unit 106 operates is different from the first operating mode (the cooling mode) that the 3# indoor unit 108 requests, and feeds back a different-mode signal to the indoor-unit controller 126 of the 3# indoor unit 108.

The indoor-unit controller 126 of the 3# indoor unit 108 turns on the indoor-unit fan 128 and the indicator of the 3# indoor unit 108 and sends a mode-conversion signal to the outdoor-unit controller 122 according to the different-mode signal. The outdoor-unit controller 122 converts the heating mode of the outdoor unit 102 to the cooling mode according to the mode-conversion signal.

When the mode conversion of the outdoor unit 102 is complete, the outdoor-unit controller 122 sends a first complete signal to the indoor-unit controller 126 of the 3# indoor unit 108.

The indoor-unit controller 126 of the 3# indoor unit 108 determines that the mode conversion of the outdoor unit 102 is complete according to the first complete signal. Then, the indoor-unit controller 126 of the 3# indoor unit 108 controls the 3# indoor unit 108 to operate under the cooling mode and sends the parameters of the cooling mode to the indoor-unit controller 126 of the 2# indoor unit 106. The indoor-unit controller 126 of the 2# indoor unit 106 controls the 2# indoor unit 106 to operate according to the parameters of the cooling mode. The parameters of the cooling mode include a cooling temperature, fan speed of the indoor-unit fan, etc. Therefore, the operating mode of the 2# indoor unit 106 is synchronized to the operating mode of the 3# indoor unit 108 and there is no need to turn off the 2# indoor unit 106. This can reduce influence caused by turning off the 2# indoor unit 106 to the user maximally.

It is noted that, the indoor unit being closed (also known as under standby state) means that, the indoor unit is under the state after the indoor unit is powered or, when the "on/off" button on the remote control of the indoor unit is pressed during the operation of the indoor unit, a state which the indoor unit is under. Under the close state (or standby state), when the "on/off" button of the remote control of the indoor unit is pressed, the indoor unit can operate under a default operating mode (such as a cooling mode) or other operating modes.

The operating mode of the indoor unit means that, an operating mode under which the indoor unit operates after the indoor unit is turned on, or after the indoor unit is turned on, the operating mode that the user chooses. The operating mode under which the indoor unit operates after the indoor unit is turned on can be a default operating mode (such as the cooling mode) or an operating mode under which the indoor unit operates before the last-time turning-off of the indoor unit. The operating mode that the user chooses can be chosen through a "Mode" button on the remote control of the indoor unit.

The heating mode of the indoor unit means that, when the user choose the heating mode using the "Mode" button on the remote control of the indoor unit, the indoor unit operates according to preset heating parameters.

The cooling mode of the indoor unit means that, when the user choose the cooling mode using the "Mode" button on the remote control of the indoor unit, the indoor unit operates according to preset cooling parameters.

Explanations for other operating modes of the indoor unit can refer to the above descriptions. Detailed descriptions are omitted.

Furthermore, the outdoor-unit control 122 controlling the outdoor unit 102 to operate under one operating mode means that, the outdoor-unit controller 122 controls the compressor 130 of the outdoor unit 102 to draw the refrigerant out from the tank 132, to make the refrigerant circulate through the closed conduits of the multi-unit air conditioning system 100, and controls the outdoor-unit heat exchanger 134 and the outdoor-unit fan 136, the four-way valve ST and related equipment of the outdoor unit 102 to operate according to the parameters of the one operating mode.

The mode conversion of the outdoor unit 102 means that, when the outdoor unit 102 operates from one operating mode to another operating mode, the outdoor-unit controller 122 controls the related equipment to change work states. For example, the outdoor-unit controller 122 controls open and close of the ports of the four-way valve ST and fan speed of the outdoor-unit fan 136, etc. After change of the work states of related equipment is complete, the outdoor-unit controller 122 sends a complete signal to the indoor-unit controller 126.

Similarly, the indoor-unit controller 126 controlling the indoor unit to operate under one operating mode means that, the indoor-unit controller 126 controls the indoor-unit heat exchanger 138 and the indoor-unit fan 128, the electronic expansion valve EX and related equipment of the indoor unit to operate according to the parameters of the one operating mode.

In the multi-unit air conditioning system 100, the first control mode can be a customized mode that solves mode-conflict problems. Under the second control mode, when the first operating mode under which the first indoor unit needs to operate is different from the second operating mode under which the second indoor unit operates, the second indoor-unit controller can control the second indoor unit to operate according to the parameters of the first operating mode, avoiding turning off the second indoor unit. This can reduce influence caused by turning off the second indoor unit to the user maximally. Meanwhile, before the mode conversion of the outdoor unit is complete, the first indoor unit turns on the indoor-unit fan first, thereby starting the first operating mode faster and saving conversion time. This improves the user's experience.

Furthermore, in the multi-unit air conditioning system 100, the first indoor-unit controller controls the first indoor unit to operate under the first operating mode only after the mode conversion of the outdoor unit 102 is complete. This can avoid the problem that the first indoor unit cannot be turned on because of the data transmission time difference. For example, referring to FIG. 1, when the 2# indoor unit 106 operates under the cooling mode and other indoor units are closed, the outdoor unit 102 operates under the cooling mode. If the indoor-unit controller 126 of the 1# indoor unit 104 turns on the heating mode of the 1# indoor unit 104 and the operating modes of other indoor units are unchanged, because of the data transmission time difference between the outdoor unit 102 and the 1# indoor unit 104, the outdoor unit 102 still operates under the cooling mode. The 1# indoor unit 104 has to stay closed and could not be turned on. At this time, if the indoor-unit controller 126 of the 3# indoor unit 108 turns on the cooling mode of the 3# indoor unit 108, because the outdoor unit 102 still operates under the cooling mode, the indoor-unit controller 126 of the 3# indoor unit 108 may immediately control the 3# indoor unit 108 to operate under the cooling mode. Meanwhile, the outdoor-unit controller 122 detects that the 1# indoor unit 104 is closed. Therefore, the information that the 3# indoor unit 108 operates under the cooling mode cannot be updated to the indoor-unit controller 126 of the 1# indoor unit 104. Therefore, the 1# indoor unit 104 will stay closed and could not be turned on.

Figure 3:
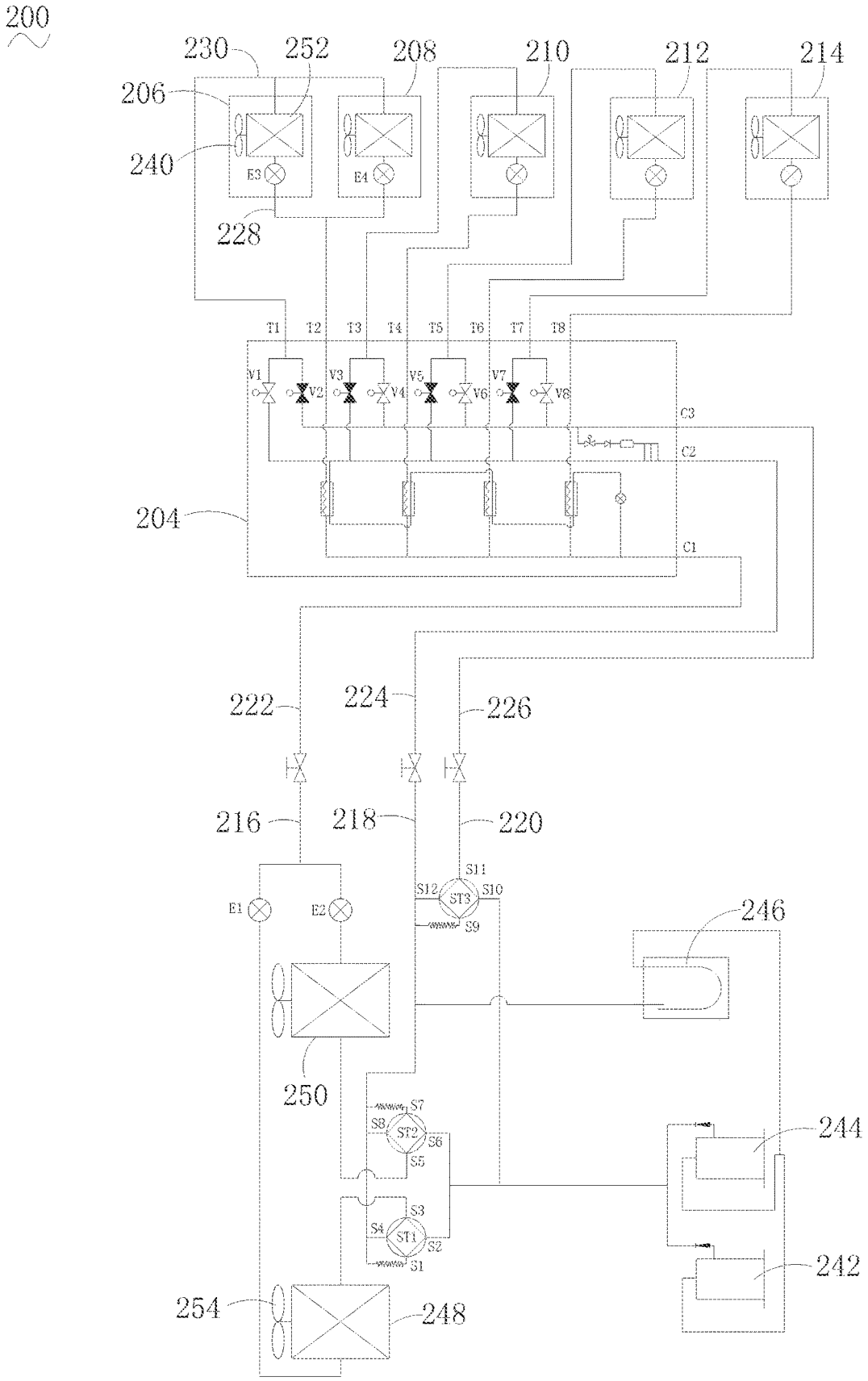
FIG. 3 is a schematic view of a multi-unit air conditioning system, according to another embodiment of the present disclosure.

Referring to FIG. 3, a multi-unit air conditioning system 200, according to a second embodiment of the present disclosure, includes an outdoor unit 202, a number of indoor units and a mode conversion device 204. The mode conversion device 204 is connected to the outdoor unit 202 and the indoor units. That is to say, one outdoor unit 202 is connected to the indoor units through the mode conversion device 204.

In this embodiment, number of the indoor unit is five. For convenient descriptions, the five indoor units are designated as 1# indoor unit 206, 2# indoor unit 208, 3# indoor unit 210, 4# indoor unit 212 and 5# indoor unit 214 from left to right in FIG. 3.

Specifically, the outdoor unit 202 includes an outdoor-unit liquid pipe 216, a first gas pipe 218 and a second gas pipe 220. The outdoor-unit liquid pipe 216 may be used to transfer liquid refrigerant. The first gas pipe 218 may be used to transfer low-pressure gaseous refrigerant. The second gas pipe 220 may be used to transfer high-pressure gaseous refrigerant.

The mode conversion device 204 includes an outdoor-unit liquid pipe port C1, a first gas pipe port C2, a second gas pipe port C3, a number of indoor-unit liquid pipe ports and a number of indoor-unit gas pipe ports. In this embodiment, number of the indoor-unit liquid pipe port is four and number of the indoor-unit gas pipe port is four.

The outdoor-unit liquid pipe 216 is connected to the outdoor-unit liquid pipe port C1 through a first connection pipe 222. The first gas pipe 218 is connected to the first gas pipe port C2 through a second connection pipe 224. The second gas pipe 220 is connected to the second gas pipe port C3 through a third connection pipe 226.

Each indoor unit includes an indoor-unit liquid pipe 228 and an indoor-unit gas pipe 230. The indoor-unit liquid pipe 228 of the 1# indoor unit 206 is connected to the indoor-unit liquid pipe 228 of the 2# indoor unit 208. The indoor-unit gas pipe 230 of the 1# indoor unit 206 is connected to the indoor-unit gas pipe 230 of the 2# indoor unit 208. Therefore, the 1# indoor unit 206 and the 2# indoor unit 208 consist of an indoor-unit assembly.

One indoor-unit liquid pipe port is connected to the indoor-unit liquid pipe 228 of one indoor unit. One indoor-unit gas pipe port is connected to the indoor-unit gas pipe 230 of one indoor unit. But for the indoor-unit assembly, the indoor-unit liquid pipe 228 of the 1# indoor unit 206 and the indoor-unit liquid pipe 228 of the 2# indoor unit 208 are connected to one indoor-unit liquid pipe port together, and the indoor-unit gas pipe 230 of the 1# indoor unit 206 and the indoor-unit gas pipe 230 of the 2# indoor unit 208 are connected to one indoor-unit gas pipe port together.

That is to say, the indoor-unit liquid pipe 228 of the 1# indoor unit 206 and the indoor-unit liquid pipe 228 of the 2# indoor unit 208 are connected to the indoor-unit liquid pipe port T2 together. The indoor-unit gas pipe 230 of the 1# indoor unit 206 and the indoor-unit gas pipe 230 of the 2# indoor unit 208 are connected to the indoor-unit gas pipe port T1 together. The indoor-unit liquid pipe 228 of the 3# indoor unit 210 is connected to the indoor-unit liquid pipe port T4. The indoor-unit gas pipe 230 of the 3# indoor unit 210 is connected to the indoor-unit gas pipe port T3. The indoor-unit liquid pipe 228 of the 4# indoor unit 212 is connected to the indoor-unit liquid pipe port T6. The indoor-unit gas pipe 230 of the 4# indoor unit 212 is connected to the indoor-unit gas pipe port T5. The indoor-unit liquid pipe 228 of the 5# indoor unit 214 is connected to the indoor-unit liquid pipe port T8. The indoor-unit gas pipe 230 of the 5# indoor unit 214 is connected to the indoor-unit gas pipe port T7.

It is noted that, in the multi-unit air conditioning system 200 of this embodiment, the indoor-unit assembly, the 3# indoor unit 210, the 4# indoor unit 212 and the 5# indoor unit 214 are connected to different indoor-unit liquid pipe ports and different indoor-unit gas pipe ports of the mode conversion device 204. Because the mode conversion device 204 can control open and close of valves which are connected to the same indoor-unit gas pipe port, such as valves V1 and V2 which are connected to the indoor-unit gas pipe port T1, or valves V3 and V4 which are connected to the indoor-unit gas pipe port T3, or valves V5 and V6 which are connected to the indoor-unit gas pipe port T5, or valves V7 and V8 which are connected to the indoor-unit gas pipe port T7, the indoor-unit gas pipes 230 of different indoor units can selectively fluidly communicate with the first gas pipe port C2 or the second gas pipe port C3. Therefore, the indoor units which are connected to different indoor-unit gas pipe ports can be controlled to operate under different operating modes. The mode conflict problem does not exist between the indoor-unit assembly, the 3# indoor unit, the 4# indoor unit and the 5# indoor unit.

For example, the valves V1, V2, V4, V5, V6, and V7 are closed and the valves V3 and V8 open. Then, the indoor-unit gas pipe 230 of the 3# indoor unit 210 fluidly communicates with the first gas pipe 218 and the indoor-unit gas pipe 230 of the 5# indoor unit 214 fluidly communicates with the second gas pipe 220. Therefore, the 3# indoor unit 210 and the 5# indoor unit 214 can operate under different operating modes.

In this embodiment, the mode-conflict problem shows between the indoor units of the indoor-unit assembly, for example, between the 1# indoor unit 206 and the 2# indoor unit 208. That is to say, the mode-conflict problem shows between the indoor units which are connected to the indoor-unit liquid pipe port and the indoor-unit gas pipe port belonging to one group. In this embodiment, the indoor-unit liquid pipe port T2 and the indoor-unit gas pipe port T1 belong to one group, and the indoor-unit liquid pipe port T4 and the indoor-unit gas pipe port T3 belong to one group, and the indoor-unit liquid pipe port T6 and the indoor-unit gas pipe port T5 belong to one group, and the indoor-unit liquid pipe port T8 and the indoor-unit gas pipe port T7 belong to one group.

Figure 4:
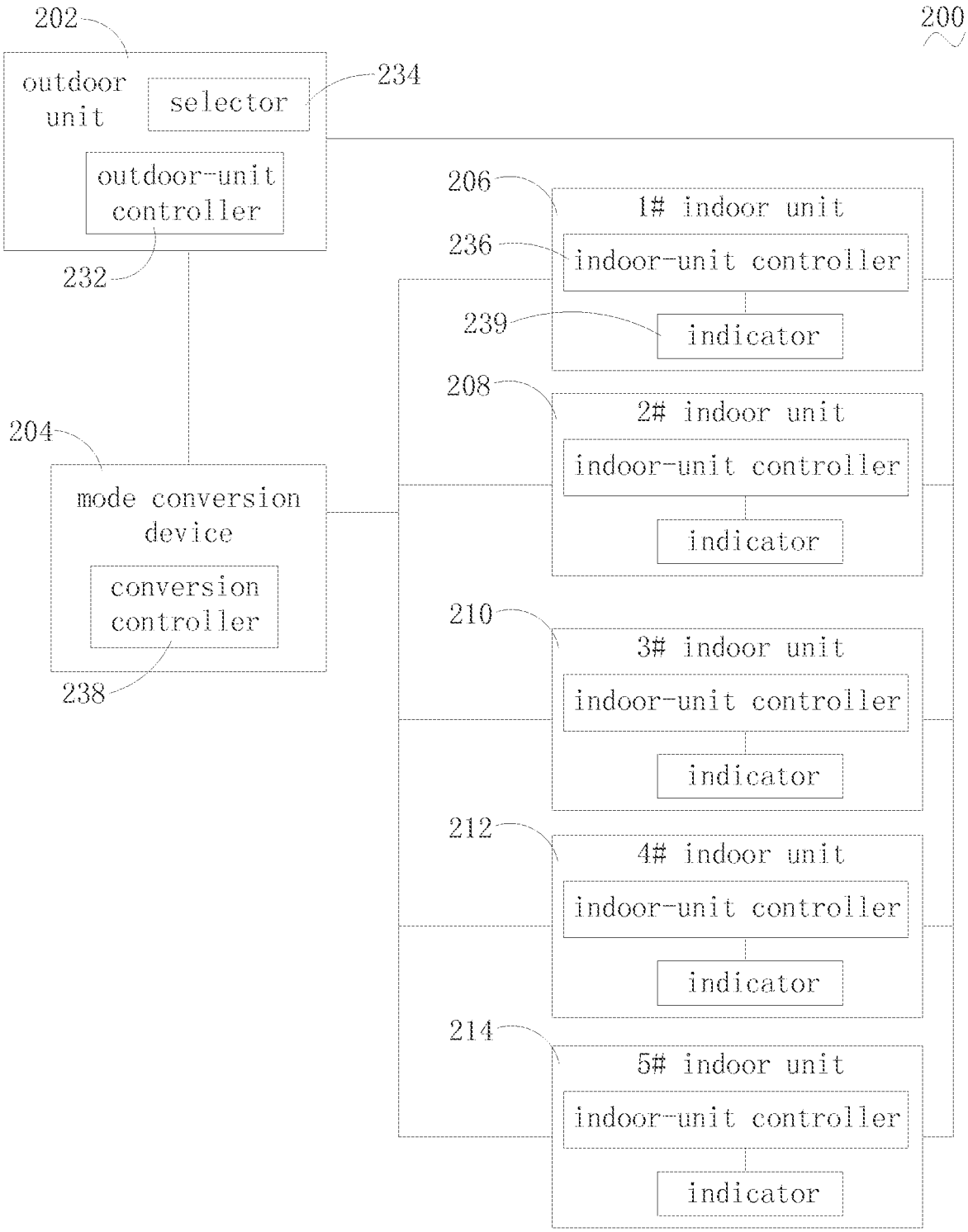
FIG. 4 is a block diagram of a multi-unit air conditioning system, according to another embodiment of the present disclosure.

Referring to FIG. 4, the outdoor unit 202 includes an outdoor-unit controller 232 and a selector 234. Each indoor unit includes an indoor-unit controller 236. The mode conversion device 204 includes a conversion controller 238.

The outdoor-unit controller 232 and the selector 234 can be set on a control board of the outdoor unit 202. The indoor-unit controller 236 can be set on a control board of the indoor unit. The conversion controller 238 can be set on a control board of the mode conversion device 204. The outdoor-unit controller 232, the indoor-unit controller 236 and the conversion controller 238 can transmit data to each other by a wired way.

Configurations of the selector 234 are similar to those of the selector 124 in the first embodiment. When receiving the first selection signal, the outdoor-unit controller 232 controls the indoor-unit controllers 236 of the 1# indoor unit 206 and 2# indoor unit 208 and the conversion controller 238 to operate under a first control mode according to the first selection signal.

When receiving the second selection signal, the outdoor-unit controller 232 controls the indoor-unit controllers 236 of the 1# indoor unit 206 and the 2# indoor unit 208 and the conversion controller 238 to operate under a second control mode according to the second selection signal.

The outdoor-unit controller 232 controls operation of the multi-unit air conditioning system 200 according to user instructions sent by the indoor unit. For example, when the multi-unit air conditioning system 200 is under standby state, all indoor units are closed. When the user presses an "on/off" button on the remote control of the indoor unit to turn on one of the indoor units, for example, the 3# indoor unit 210, the indoor-unit controller 236 of the 3# indoor unit 210 receives the turn-on instruction and transmits the turn-on instruction to the outdoor-unit controller 232. The outdoor-unit controller 232 controls the outdoor unit 202, the mode conversion device 204 and the 3# indoor unit 210 to operate under a default operating mode or an operating mode under which the 3# indoor unit 210 operates before last-time turning-off of the 3# indoor unit 210.

The conversion controller 238 is configured to control the mode conversion device 204 to operate according to the control signal of the indoor-unit controller 236.

The indoor-unit controller 236 is configured to receive and transmit the user instruction to the outdoor-unit controller 232, and control the indoor unit according to a control signal fed back by the outdoor-unit controller 232. As stated above, the indoor-unit controller 236 of the 3# indoor unit 210 transmits the turn-on instruction to the outdoor-unit controller 232 and receives the control signal fed back by the outdoor-unit controller 232, and controls the 3# indoor unit 310 to operate under the default operating mode or other operating modes according to the control signal fed back by the outdoor-unit controller 232.

Under the first control mode (the outdoor-unit controller 232 is under the asynchronous control mode), the multi-unit air conditioning system 200 can process mode conflict of the indoor units according to customized mode-conflict solutions. For example, the customized mode-conflict solutions include a cooling priority solution, a heating priority solution, a turned-on-most priority solution and a VIP priority solution. These customized mode-conflict solutions can be preset in the non-volatile memory on the control board of the outdoor unit 202. Similarly, the control logic of the second control mode can also be stored in the non-volatile memory on the control board of the outdoor unit 202.

In this embodiment, explanations of the cooling priority solution, the heating priority solution, the turned-on-most priority solution and the VIP priority solution can be referred to the explanations in the multi-unit air conditioning system 100 of the first embodiment. In this embodiment, when these solutions are carried out, the mode conversion device 204 also needs to convert the operating mode to match the operating mode of the multi-unit air conditioning system 200.

The cooling priority solution is made as an example to solve the mode-conflict problem under the first control mode.

Initially, the 3#-5# indoor units 210, 212, 214 and the 1# indoor unit 206 of the indoor-unit assembly are closed. The 2# indoor unit 208 operates under the heating mode.

When the user turns on the cooling mode of the 1# indoor unit 206 using the remote control of the indoor unit, the indoor-unit controller 236 of the 1# indoor unit 206 receives and sends a mode-on signal of the cooling mode to the outdoor-unit controller 232. The outdoor-unit controller 232 determines that the operating mode (the heating mode) under which the 2# indoor unit 208 operates currently is different from the operating mode (the cooling mode) under which the 1# indoor unit 206 is about to operate. The outdoor-unit controller 232 uses the operating mode under which the 1# indoor unit 206 is about to operate as the priority operating mode, and sends an off signal to the 2# indoor unit 208 and controls the outdoor unit 202 and the mode conversion device 204 to operate under the cooling mode. The indoor-unit controller 236 of the 2# indoor unit 208 turns off the 2# indoor unit 208 according to the off signal. Then, the outdoor-unit controller 232 and the conversion controller 238 send mode-conversion complete signals to the indoor-unit controller 236 of the 1# indoor unit 206. The indoor-unit controller 236 of the 1# indoor unit 206 controls the 1# indoor unit 206 to operate under the cooling mode according to the mode-conversion complete signal.

Under the second control mode (the outdoor-unit controller 232 is under the synchronous control mode), when one of the indoor-unit controllers 236 (hereafter the first indoor-unit controller) receives the mode-on signal from the remote control of the indoor unit, the first indoor-unit controller sends the mode-on signal to the outdoor-unit controller 232. The mode-on signal is used to turn on a first operating mode of one of the indoor units (hereafter the first indoor unit)

The outdoor-unit controller 232 is configured to determine whether a second operating mode under which another indoor unit (hereafter the second indoor unit) operates is the same as the first operating mode.

If no, the first indoor-unit controller is configured to turn on an indoor-unit fan of the first indoor unit and send a mode conversion signal to the outdoor-unit controller 232 and the conversion controller 238. The outdoor-unit controller 232 is configured to convert the operating mode of the outdoor unit 202 according to the mode conversion signal. The conversion controller 238 is configured to convert the operating mode of the mode conversion device 204 according to the mode conversion signal.

When the mode conversion of the outdoor unit 202 and the mode conversion device 204 is complete, the first indoor-unit controller is configured to control the first indoor unit to operate under the first operating mode, and send parameters of the first operating mode to the second indoor-unit controller. Specifically, when the mode conversion of the outdoor unit 202 is complete, the outdoor-unit controller 232 is configured to send a first complete signal to the first indoor-unit controller. When the mode conversion of the mode conversion device 204 is complete, the conversion controller 238 is configured to send a second complete signal to the first indoor-unit controller. The first indoor-unit controller is configured to determine that the mode conversion of the outdoor unit 202 and the mode conversion device 204 is complete according to the first complete signal and the second complete signal.

The second indoor-unit controller is configured to control operation of the second indoor unit according to the parameters of the first operating mode.

If yes, the first indoor-unit controller is configured to control the first indoor unit to operate under the first operating mode.

Preferably, each indoor unit includes an indicator 239. If the second operating mode is different from the first operating mode, the first indoor-unit controller is configured to turn on the indicator 239. In this way, the user can know about the operating of each indoor unit.

Furthermore, the mode conversion of the mode conversion device 204 means that, when one operating mode of the mode conversion device 204 is converted to another operating mode of the mode conversion device 204, the conversion controller 238 controls related equipments of the mode conversion device 204 to change work states according to another operating mode. For example, the conversion controller 238 controls open and close of the valves V1~V8, etc. After change of the work states of the related equipment is complete, the conversion controller 238 sends a complete signal to the indoor-unit controller 236.

An example is made to solve the mode-conflict problem under the second control mode.

The 1# indoor unit 206 is designated as the first indoor unit, and the 2# indoor unit 208 is designated as the second indoor unit. Initially, the 3# indoor unit 210, the 4# indoor unit 212, the 5# indoor unit 214 and the 1# indoor unit 206 of the indoor-unit assembly are closed, and the 2# indoor unit 208 operates under the heating mode (the second operating mode).

When the user turns on the cooling mode (the first operating mode) of the 1# indoor unit 206 using the remote control of the indoor unit, the indoor-unit controller 236 (the first indoor-unit controller) of the 1# indoor unit 206 receives and sends the mode-on signal to the outdoor-unit controller 232. The mode-on signal is used to turn on the cooling mode (the first operating mode) of the 1# indoor unit 206.

The outdoor-unit controller 232 determines that the second operating mode (the heating mode) of the 2# indoor unit 208 is different from the first operating mode (the cooling mode) that the 1# indoor unit 206 requests, and feeds back a different-mode signal to the indoor-unit controller 236 of the 1# indoor unit 206.

The indoor-unit controller 236 of the 1# indoor unit 206 turns on the indoor-unit fan 240 and the indicator 239 of the 1# indoor unit 206 according to the different-mode signal and sends a mode-conversion signal to the outdoor-unit controller 232 and the conversion controller 238. The outdoor-unit controller 232 controls the outdoor unit 202 to convert the operating mode from the heating mode to the cooling mode for the 1# indoor unit 206 according to the mode-conversion signal. The conversion controller 238 controls the mode conversion device 204 to convert the operating mode from the heating mode to the cooling mode for the 1# indoor unit 206 according to the mode-conversion signal.

When the mode conversion of the outdoor unit 202 is complete, the outdoor-unit controller 232 sends a first complete signal to the indoor-unit controller 236 of the 1# indoor unit 206. When the mode conversion of the mode conversion device 204 is complete, the conversion controller 238 sends a second complete signal to the indoor-unit controller 236 of the 1# indoor unit 206.

The indoor-unit controller 236 of the 1# indoor unit 206 determines that the mode conversion of the outdoor unit 202 and the mode conversion device 204 is complete according to the first complete signal and the second complete signal. Then, the indoor-unit controller 236 of the 1# indoor unit 206 controls the 1# indoor unit 206 to operate under the cooling mode and sends the parameters of the cooling mode to the indoor-unit controller 236 of the 2# indoor unit 208. The indoor-unit controller 236 of the 2# indoor unit 208 controls the 2# indoor unit 208 to operate according to the parameters of the cooling mode. The parameters of the cooling mode include a cooling temperature, fan speed of the indoor-unit fan 240, etc. Therefore, the operating mode of the 2# indoor unit 208 of the indoor-unit assembly is synchronized to the operating mode of the 1# indoor unit 206. Therefore, there is no need to turn off the 2# indoor unit 208, and this can reduce influence caused by turning off the 2# indoor unit 208 to the user maximally.

Other detailed descriptions of the multi-unit air conditioning system 200 in this embodiment can be referred to similar detailed descriptions of the multi-unit air conditioning system 100 in the first embodiment.

Especially, in this embodiment, when the multi-unit air conditioning system 200 only operates under the cooling mode, such as only the 1# indoor unit 206 operates under the cooling mode, the outdoor-unit controller 232 controls a first compressor 242 and a second compressor 244 of the outdoor unit 202 to draw the refrigerant out from the tank 246. Then, the high-pressure liquid refrigerant outputted from the first compressor 242 and the second compressor 244 enters a first outdoor-unit heat exchanger 248 through a port S2 and a port S3 of the four-way valve ST1, and enters a second outdoor-unit heat exchanger 250 through a port S6 and a port S5 of the four-way valve ST2. A port S10 of the four-way valve ST3 is blocked from a port S11 of the four-way valve ST3.

The two-path high-pressure liquid refrigerant enters the outdoor-unit liquid pipe 216 through the outdoor-unit electronic expansion valves E1 and E2. Then, the high-pressure liquid refrigerant enters the mode conversion device 204 through the outdoor-unit liquid pipe port C1, and enters the indoor-unit heat exchanger 252 of the 1# indoor unit 206 through the indoor-unit liquid pipe port T2, the indoor-unit liquid pipe 228 and the electronic expansion valve E3 of the 1# indoor unit 206. The high-pressure liquid refrigerant transforms into a low-pressure gaseous refrigerant in the indoor-unit heat exchanger 252 and meanwhile, the refrigerant absorbs heat to cool the environment. The indoor-unit fan 240 of the 1# indoor unit 206 is turned on, making the air flow through the indoor-unit heat exchanger 252. Therefore, the air which the indoor-unit fan 240 blows is cool wind.

Additionally, because only the 1# indoor unit 206 operates under the cooling mode, the conversion controller 238 controls the valve V1 to open and controls the valves V2~V8 to close. The low-pressure gaseous refrigerant enters the mode conversion device 204 through the indoor-unit gas pipe 230 of the 1# indoor unit 206 and the corresponding indoor-unit gas pipe port T1. Then the low-pressure gaseous refrigerant enters the tank 246 through the first gas pipe port C2 and the first gas pipe 218. Therefore, a cooling cycle is complete.

When the multi-unit air conditioning system 200 only operates under the heating mode, such as only the 2# indoor unit 208 operates under the heating mode, the outdoor-unit controller 232 controls the first compressor 242 and the second compressor 244 of the outdoor unit 202 to draw the refrigerant out from the tank 246. Then, the high-pressure gaseous refrigerant outputted from the first compressor 242 and the second compressor 244 enters the mode conversion device 204 through the port S10 and the port S11 of the four-way valve ST3, the second gas pipe 220 and the second gas pipe port C3. The port S2 of the four-way valve ST1 is blocked from the port S3 of the four-way valve ST1. The port S5 of the four-way valve ST2 is blocked from the port S6 of the four-way valve ST2.

Additionally, because only the 2# indoor unit 208 operates under the heating mode, the conversion controller 238 controls the valve V2 to open and controls the valves V1, V3~V8 to close. After entering the mode conversion device 204, the high-pressure gaseous refrigerant enters the indoor-unit heat exchanger 252 of the 2# indoor unit 208 through the valve V2, the indoor-unit gas pipe port T1 and the indoor-unit gas pipe 230 of the 2# indoor unit 208. The high-pressure gaseous refrigerant transforms into a high-pressure liquid refrigerant in the indoor-unit heat exchanger 252 of the 2# indoor unit 208 and meanwhile, the refrigerant releases heat to heat the environment. The indoor-unit fan 240 of the 2# indoor unit 208 is turned on, making the air flow through the indoor-unit heat exchanger 252. Therefore, the air which the indoor-unit fan 240 of the 2# indoor unit 208 blows is heat wind.

After outputted from the indoor-unit heat exchanger 252 of the 2# indoor unit 208, the high-pressure liquid refrigerant enters the mode conversion device 204 through the electronic expansion valve E4 and the indoor-unit liquid pipe 228 of the 2# indoor unit 208, and the corresponding indoor-unit liquid pipe port T2. Then, the high-pressure liquid refrigerant enters the first outdoor-unit heat exchanger 248 and the second outdoor-unit heat exchanger 250 through the outdoor-unit liquid pipe port C1 of the mode conversion device 204, the outdoor-unit liquid pipe 216, and the outdoor-unit electronic expansion valves E1 and E2.

The refrigerant outputted from the first outdoor-unit heat exchanger 248 enters the tank 246 through the port S3 and the port S4 of the four-way valve ST1. The refrigerant outputted from the second outdoor-unit heat exchanger 250 enters the tank 246 through the port S5 and the port S8 of the four-way valve ST2. Therefore, a heating cycle is complete.

Therefore, when the operating mode of the multi-unit air conditioning system 200 is converted between the cooling mode and the heating mode, the outdoor-unit controller 232 controls open and close of the ports of the four-way valves ST1, ST2 and ST3 of the outdoor unit 202 to achieve the mode conversion. The conversion controller 238 controls open and close of the valves V1~V8 to control open and close of related paths to achieve the mode conversion.

Additionally, the related equipment, such as the outdoor-unit fan 254 and the outdoor-unit electronic expansion valves E1, E2 in the outdoor unit 202, and the related equipment, such as the indoor-unit fan 240 and the indoor-unit electronic expansion valves E3, E4 in the indoor unit can be controlled according to practical use and other known methods. Detailed descriptions are omitted.

Advantages of the multi-unit air conditioning system 200 in this embodiment are similar to those of the multi-unit air conditioning system 100 in the first embodiment. Furthermore, because there is a mode conversion device 204, the multi-unit air conditioning system 200 can allow the indoor units which are connected to the indoor-unit liquid pipe ports and the indoor-unit gas pipe ports in different groups to operate under different operating modes. This enriches application of the multi-unit air conditioning system 200 and increases the user's choice and improves the user experience.

Figure 5:
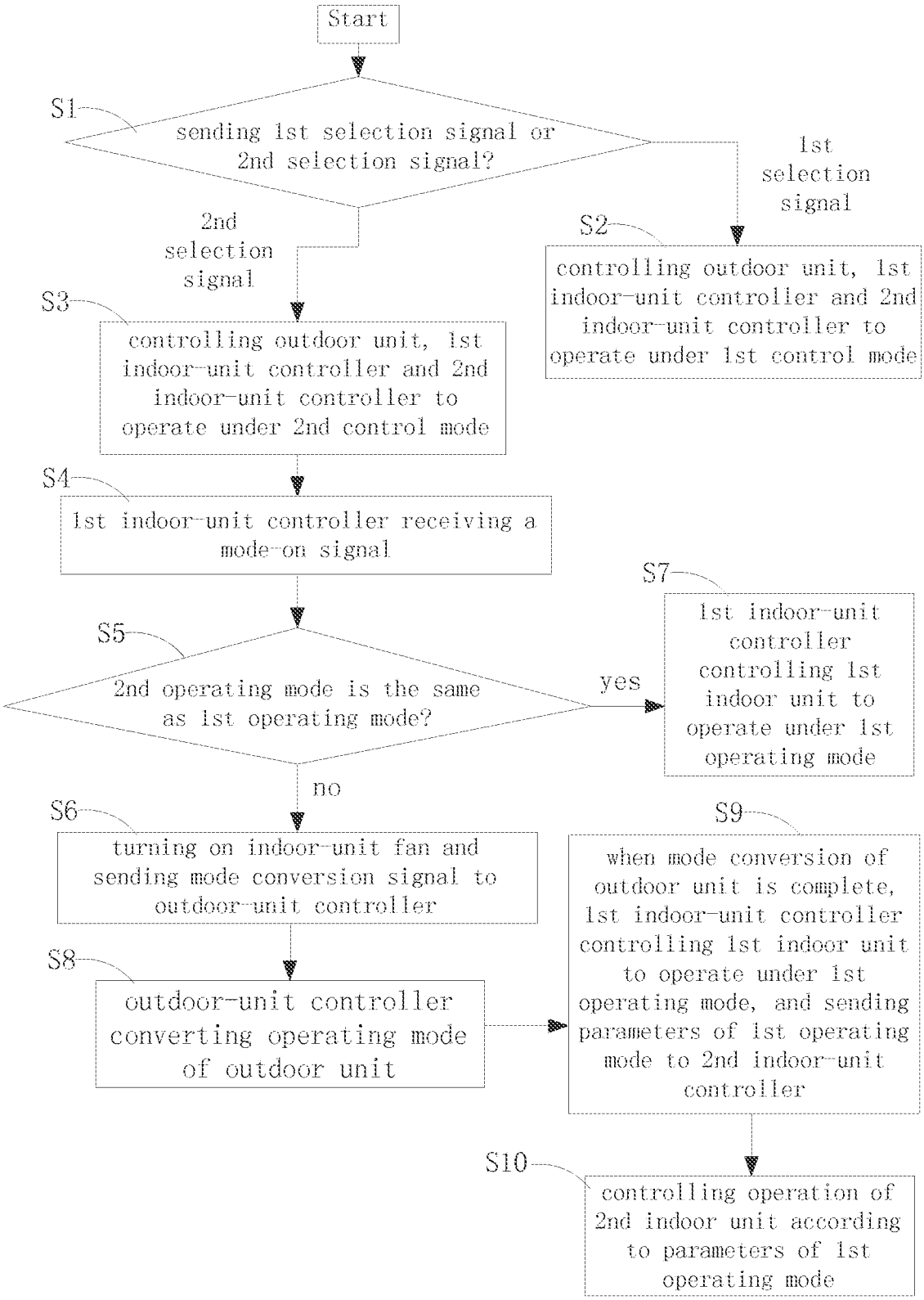
FIG. 5 is a flow chart of a controlling method of a multi-unit air conditioning system, according to one embodiment of the present disclosure.

Referring to FIG. 5, a controlling method of a multi-unit air conditioning system, according to a third embodiment of the present disclosure, is provided. The controlling method can be implemented by the multi-unit air conditioning system 100 in the first embodiment.

The controlling method includes following steps of:

S1: the selector 124 sending a first selection signal, and entering step S2, or the selector 124 sending a second selection signal and entering step S3;

S2: the outdoor-unit controller 122 controlling the outdoor unit 102, the first indoor unit and the second indoor unit to operate under a first control mode according to the first selection signal;

S3: the outdoor-unit controller 122 controlling the outdoor unit 102, the first indoor unit and the second indoor unit to operate under a second control mode according to the second selection signal, and entering step S4;

S4: the first indoor-unit receiving a mode-on signal, the mode-on signal being used to turn on a first operating mode of the first indoor unit, and entering step S5;

S5: the outdoor-unit controller 122 determining whether a second operating mode under which the second indoor unit operates is the same as the first operating mode, if no, entering step S6, if yes, entering step S7;

S6: the first indoor-unit controller turning on an indoor-unit fan 128 of the first indoor unit and sending a mode conversion signal to the outdoor-unit controller 122, and entering step S8;

S7: the first indoor-unit controller controlling the first indoor unit to operate under the first operating mode;

S8: the outdoor-unit controller 122 converting an operating mode of the outdoor unit 102 according to the mode conversion signal, and entering step S9;

S9: when mode conversion of the outdoor unit 102 is complete, the first indoor-unit controller controlling the first indoor unit to operate under the first operating mode, and sending parameters of the first operating mode to the second indoor-unit controller, and entering step S10;

S10: the second indoor-unit controller controlling operation of the second indoor unit according to the parameters of the first operating mode.

In the step S1, the selector 124 sends the first selection signal or the second selection signal according to the DIP switch. The DIP switch can be controlled by the user.

In the step S2, i.e., the selector 124 sends the first selection signal, the outdoor-unit controller 122 is under the asynchronous control mode. The multi-unit air conditioning system 100 can process mode conflict of the indoor units according to customized mode-conflict solutions. For example, the customized mode-conflict solutions include a cooling priority solution, a heating priority solution, a turned-on-most priority solution and a VIP priority solution, etc. These customized mode-conflict solutions can be preset in the non-volatile memory on the control board of the outdoor unit 102.

In the step S3, i.e., the selector 124 sends the second selection signal, the outdoor-unit controller 122 is under the synchronous control mode. The control logic of the second control mode can also be stored in the non-volatile memory on the control board of the outdoor unit 102.

The 3# indoor unit 108 is designated as the first indoor unit, and the 2# indoor unit 106 is designated as the second indoor unit. Initially, the 1# indoor unit 104 and the 3# indoor unit 108 are closed, and the 2# indoor unit 106 operates under the heating mode (the second operating mode).

In the step S4, for example, when the user turns on the cooling mode (the first operating mode) of the 3# indoor unit 108 using the remote control of the 3# indoor unit 108, the indoor-unit controller 126 (the first indoor-unit controller) of the 3# indoor unit 108 receives and sends the mode-on signal to the outdoor-unit controller 122. The mode-on signal is used to turn on the cooling mode (the first operating mode).

In the step S5, the outdoor-unit controller 122 determines that the second operating mode under which the 2# indoor unit 106 operates currently is different from the first operating mode that the 3# indoor unit 108 requests according to the mode-on signal.

In the step S6, i.e., the second operating mode is different from the first operating mode, the outdoor-unit controller 122 feeds back a different-mode signal to the indoor-unit controller 126 of the 3# indoor unit 108.

In this embodiment, preferably, the indoor unit further includes an indicator. The step S6 includes: the first indoor-unit controller turning on the indicator 127. That is, the indoor-unit controller 126 of the 3# indoor unit 108 turns on the indoor-unit fan 128 and the indicator 127 of the 3# indoor unit 108 according to the different-mode signal. In this way, the user can know about the operation of each indoor unit. Meanwhile, the indoor-unit controller 126 of the 3# indoor unit 108 sends a mode-conversion signal to the outdoor-unit controller 122.

In the step S7, i.e., the second operating mode is the same as the first operating mode, the indoor-unit controller 126 of the 3# indoor unit 108 controls the 3# indoor unit 108 to operate under the first operating mode.

In the step S8, the outdoor-unit controller 122 controls related equipments of the outdoor unit 102 to change work states. For example, the outdoor-unit controller 122 controls open and close of the ports of the four-way valve ST and fan speed of the outdoor-unit fan 136, etc.

Preferably, the step S9 includes follow steps of:

S91: when the mode conversion of the outdoor unit 102 is complete, the outdoor-unit controller 122 sending a first complete signal to the first indoor-unit controller, and entering step S92;

S92: the first indoor-unit controller determining that the mode conversion of the outdoor unit 102 is complete according to the first complete signal, and entering step S93;

S93: the first indoor-unit controller controlling the first indoor unit to operate under the first operating mode and sending the parameters of first operating mode to the second indoor-unit controller, and entering step S10.

In the step S91, after change of the work states of related equipments of the outdoor unit 102 is complete, the outdoor-unit controller 122 sends a first complete signal to the indoor-unit controller 126.

In the step S10, the indoor-unit controller 126 of the 2# indoor unit 106 controls the 2# indoor unit 106 to operate according to the parameters of the cooling mode. Therefore, the operating mode of the 2# indoor unit 106 is synchronized to the operating mode of the 3# indoor unit 108 and there is no need to turn off the 2# indoor unit 106. This can reduce influence caused by turning off the 2# indoor unit 106 to the user maximally.

Other un-described parts in this embodiment can be referred to the multi-unit air conditioning system 100 in the above embodiment. Detailed descriptions are omitted here.

In the controlling method of the multi-unit air conditioning system 100, the first control mode can be a customized mode that solves mode-conflict problems. Under the second control mode, when the first operating mode under which the first indoor unit needs to operate is different from the second operating mode under which the second indoor unit operates, the second indoor-unit controller can control the second indoor unit to operate according to the parameters of the first operating mode, avoiding turning off the second indoor unit. This can reduce influence caused by turning off the second indoor unit to the user maximally. Meanwhile, before the mode conversion of the outdoor unit is complete, the first indoor unit turns on the indoor-unit fan first, thereby starting the first operating mode faster and saving conversion time. This improves the user's experience.

Figure 6:
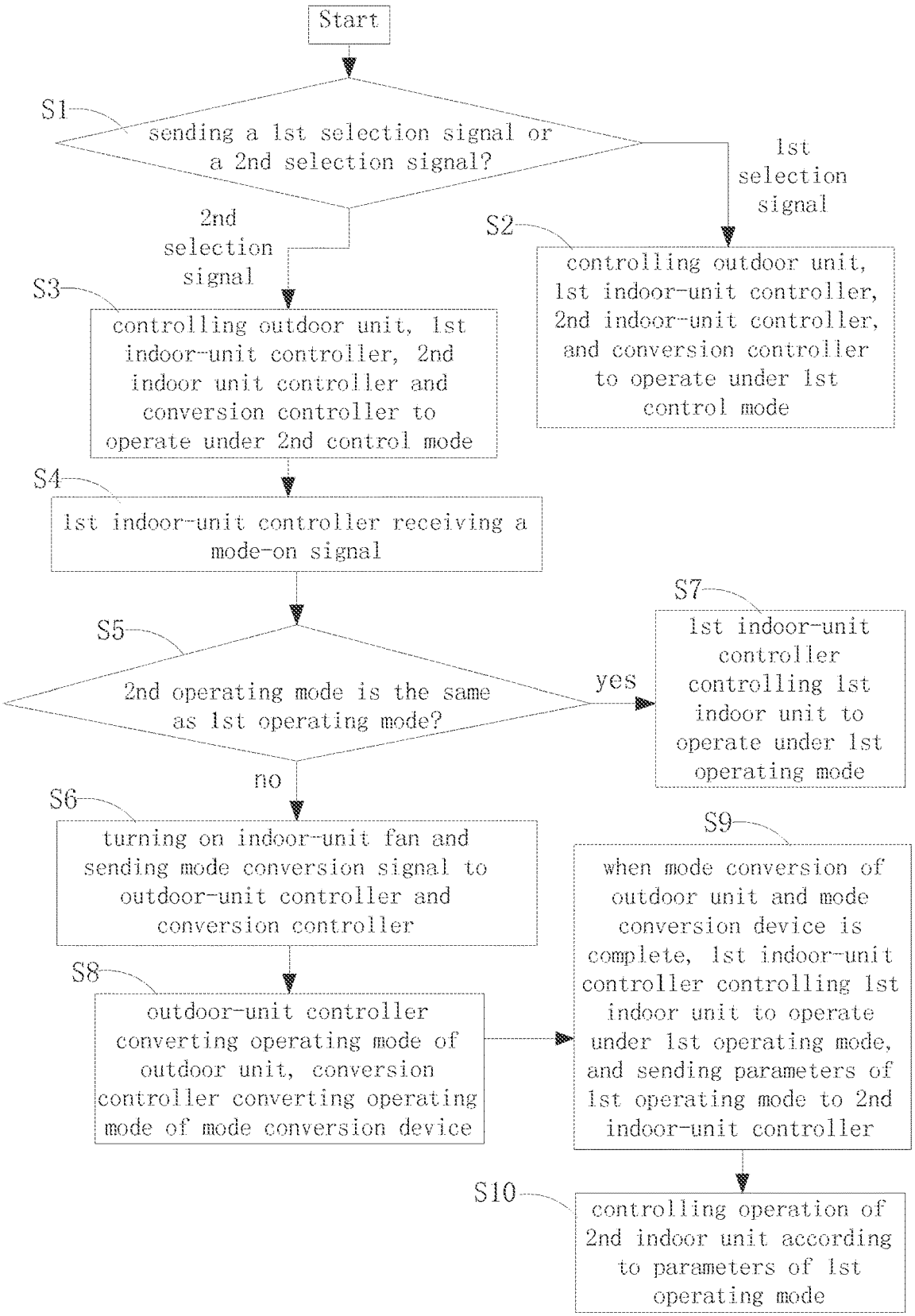
FIG. 6 is a flow chart of a controlling method of a multi-unit air conditioning system, according to another embodiment of the present disclosure.

Referring to FIG. 6, a controlling method of a multi-unit air conditioning system, according to a fourth embodiment of the present disclosure, is provided. The controlling method can be implemented by the multi-unit air conditioning system 200 in the second embodiment.

The controlling method in this embodiment is substantially the same as the controlling method in the third embodiment. Following are the differences.

Specifically, the step S2 includes: the outdoor-unit controller 232 controlling the conversion controller 238 to operate under the first control mode according to the first selection signal.

The step S3 includes: the outdoor-unit controller 232 controlling the conversion controller 238 to operate under the second control mode according to the second selection signal.

The step S6 includes: the first indoor-unit controller sending the mode conversion signal to the conversion controller 238.

The step S8 includes: the conversion controller 238 converting an operating mode of the mode conversion device 204 according to the mode conversion signal.

The step S9 includes: when the mode conversion of the mode conversion device 204 is complete, the first indoor-unit controller controlling the first indoor unit to operate under the first operating mode, and sending the parameters of the first operating mode to the second indoor-unit controller, and entering the step S10.

In the step S2, the outdoor-unit controller 232 controls the conversion controller 238 to solve the mode conflict problem according to the first control mode.

In the step S3, the outdoor-unit controller 232 controls the conversion controller 238 to solve the mode conflict problem according to the second control mode.

In the step S6, the indoor-unit controller 236 sends the mode conversion signal to the conversion controller 238 to make the conversion 238 convert the operating mode of the mode conversion device 204.

In the step S8: the conversion controller 238 converts the operating mode of the mode conversion device 204. For example, the conversion controller 238 controls open and close of the valves V1~V8 to convert the operating mode according to needs.

Preferably, the step S9 includes follow steps of:

S91: when the mode conversion of the outdoor unit 202 is complete, the outdoor-unit controller 232 sending a first complete signal to the first indoor-unit controller, when the mode conversion of the mode conversion device 204 is complete, the conversion controller 238 sending a second complete signal to the first indoor-unit controller, and entering step S92;

S92: the first indoor-unit controller determining that the mode conversion of the outdoor unit 202 and the mode conversion device 204 is complete according to the first complete signal and the second complete signal, and entering step S93.

S93: the first indoor-unit controller controlling the first indoor unit to operate under the first operating mode, and sending the parameters of the first operating mode to the second indoor-unit controller, and entering the step S10.

In the step S91, after change of the work states of related equipments of the outdoor unit 202 is complete, the outdoor-unit controller 232 sends a first complete signal to the indoor-unit controller 236. For example, after open and/or close of the valves V1~V8 are complete, the conversion controller 238 sends a second complete signal to the indoor-unit controller 236.

Other un-described parts of the controlling method in this embodiment can be referred to the multi-unit air conditioning system 100, 200 in the above embodiments. Detailed descriptions are omitted here.

Advantages of the controlling method in this embodiment are similar to those of the controlling method in the third embodiment. Furthermore, because there is a mode conversion device 204, the controlling method of the multi-unit air conditioning system can allow the indoor units which are connected to the indoor-unit liquid pipe ports and the indoor-unit gas pipe ports in different groups to operate under different operating modes. This enriches application of the controlling method of the multi-unit air conditioning system and increases the user's choice and improves the user experience.

Reference throughout this specification to "an embodiment", "some embodiments", "one embodiment", "an example", "a specific example", or "some examples" means that a particular feature, structure, material, or characteristic described in connection with the embodiment or example is included in at least one embodiment or example of the disclosure. In the descriptions, expressions of the above terms does not need for same embodiments or examples. Furthermore, the feature, structure, material, or characteristic described can be incorporated in a proper way in any one or more embodiments or examples. In addition, under non-conflicting condition, those skilled in the art can incorporate or combine features described in different embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. A multi-unit air conditioning system, comprising an outdoor unit, indoor units including at least a first indoor unit, a second indoor unit and a third indoor unit, and a mode conversion device;

wherein the outdoor unit comprising an outdoor-unit controller and a selector, each indoor unit comprising an indoor-unit controller, the first indoor unit comprising a first indoor-unit controller, the second indoor unit comprising a second indoor-unit controller;

wherein the selector being configured to send a first selection signal according to a user instruction under asynchronous control mode, or send a second selection signal according to the user instruction under synchronous control mode;

wherein the outdoor-unit controller being configured to control the outdoor unit, the first indoor-unit controller and the second indoor-unit controller to operate under the asynchronous control mode according to the first selection signal, wherein an operating mode conflict between the first and second indoor units is resolved according to a predetermined mode-conflict solution under the asynchronous control mode, the predetermined mode-conflict solution is preset in the outdoor-unit controller and comprises one of: a cooling priority solution, a heating priority solution and a turned-on-most priority solution; and wherein the outdoor-unit controller being configured to control the outdoor unit, the first indoor-unit controller and the second indoor-unit controller to operate under the synchronous control mode according to the second selection signal, wherein the operating mode conflict between the first and second indoor units is resolved as follows under the synchronous control mode:

the first indoor-unit controller turns on an indoor-unit fan of the first indoor unit, the first indoor-unit controller sends a mode conversion signal to the outdoor-unit controller, the outdoor-unit controller converts operating mode of the outdoor unit according to the mode conversion signal, when mode conversion of the outdoor unit is complete, the first indoor-unit controller (a) controls the first indoor unit to operate under a first operating mode and (b) sends parameters of the first operating mode to the second indoor-unit controller, and the second indoor-unit controller controls operation of the second indoor unit according to the parameters of the first operating mode;

wherein the mode conversion device comprises a conversion controller;

the outdoor-unit controller being configured to control the conversion controller to operate under the asynchronous control mode according to the first selection signal, and control the conversion controller to operate under the synchronous control mode according to the second selection signal;

wherein the first indoor-unit controller being configured to send the mode conversion signal to the conversion controller if the second indoor unit is operating in a different mode than the first indoor unit;

wherein the conversion controller being configured to convert the operating mode of the mode conversion device according to the mode conversion signal; and wherein the first indoor-unit controller being configured to control the first indoor unit to operate under the first operating mode and send the parameters of the first operating mode to the second indoor-unit controller, when the mode conversion of the mode conversion device is complete;

wherein the outdoor unit comprises an outdoor-unit liquid pipe, a first gas pipe configured to transfer low-pressure gaseous refrigerant and a second gas pipe configured to transfer high-pressure gaseous refrigerant;

the mode conversion device further comprises an outdoor-unit liquid pipe port, a first gas pipe port, a second gas pipe port, a first indoor-unit liquid pipe port, a second indoor-unit liquid pipe port, a third indoor-unit liquid pipe port, a first indoor-unit gas pipe port, a second indoor-unit gas pipe port, a third indoor-unit gas pipe port, and multiple valves configured to operate by instruction of the conversion controller;

the first indoor unit comprises a first indoor-unit liquid pipe and a first indoor-unit gas pipe, the second indoor unit comprises a second indoor-unit liquid pipe and a second indoor-unit gas pipe, the third indoor unit comprises a third indoor-unit liquid pipe and a third indoor-unit gas pipe;

the outdoor-unit liquid pipe is connected to the outdoor-unit liquid pipe port, the first gas pipe is connected to the first gas pipe port, the second gas pipe is connected to the second gas pipe port;

the first indoor-unit liquid pipe port is connected to the first indoor-unit liquid pipe, the second indoor-unit liquid pipe port is connected to the second indoor-unit liquid pipe, the third indoor-unit liquid pipe port is connected to the third indoor-unit liquid pipe, the first indoor-unit gas pipe port is connected to the first indoor-unit gas pipe, the second indoor-unit gas pipe port is connected to the second indoor-unit gas pipe, the third indoor-unit gas pipe port is connected to the third indoor-unit gas pipe;

the first indoor-unit liquid pipe is connected with the second indoor-unit liquid pipe, the first indoor-unit gas pipe is connected with the second indoor-unit gas pipe, the first indoor unit and the second indoor unit is combined to be an indoor-unit assembly;

each of the multiple valves is provided between each indoor-unit gas pipe and the first gas pipe port or the second gas pipe port, and configured to selectively connect or disconnect refrigerant communication between each indoor-unit gas pipe and the first gas pipe port or the second gas pipe port;

the indoor-unit assembly and the third indoor unit are configured to operate under different operating modes through connection and disconnection of the multiple valves;

wherein the parameters of the first operating mode comprise a set temperature and a fan speed.

2. The multi-unit air conditioning system of claim 1, wherein the outdoor-unit controller is configured to send a first complete signal to the first indoor-unit controller when the mode conversion of the outdoor unit is complete; and the first indoor-unit controller is configured to determine that the mode conversion of the outdoor unit is complete according to the first complete signal.

3. The multi-unit air conditioning system of claim 1, wherein the outdoor-unit controller is configured to send a first complete signal to the first indoor-unit controller, when the mode conversion of the outdoor unit is complete;

the conversion controller is configured to send a second complete signal to the first indoor- unit controller, when the mode conversion of the mode conversion device is complete; and the first indoor-unit controller is configured to determine that the mode conversion of the outdoor unit and the mode conversion device is complete according to the first complete signal and the second complete signal.

4. The multi-unit air conditioning system of claim 1, wherein the first indoor unit comprises an indicator; and the first indoor-unit controller is configured to turn on the indicator if the second indoor unit is operating in a different mode than the first indoor unit.

5. The multi-unit air conditioning system of claim 1, wherein according to the cooling priority solution, when one of the indoor units needs to operate under cooling mode, the outdoor-unit controller controls the outdoor unit to operate under the cooling mode immediately, and controls the other indoor-unit controllers to turn off the other indoor units operating under different operating mode;

wherein according to the heating priority solution, when one of the indoor units needs to operate under heating mode, the outdoor-unit controller controls the outdoor unit to operate under the heating mode immediately, and controls the other indoor-unit controllers to turn off the other indoor units operating under different operating mode; and wherein according to the turned-on-most priority solution, the outdoor-unit controller uses operating mode under which most of the indoor units operate as the priority operating mode, and controls the other indoor-unit controllers to turn off the other indoor units operating under different operating mode.

* * * * *